US011245976B2

(12) United States Patent
Li et al.

(10) Patent No.: US 11,245,976 B2
(45) Date of Patent: Feb. 8, 2022

(54) EARPHONE SIGNAL PROCESSING METHOD AND SYSTEM, AND EARPHONE

(71) Applicant: Beijing Xiaoniao Tingting Technology Co., LTD, Beijing (CN)

(72) Inventors: Bo Li, Beijing (CN); Jiudong Wang, Beijing (CN)

(73) Assignee: Beijing Xiaoniao Tingting Technology Co., LTD., Beijing (CN)

( * ) Notice: Subject to any disclaimer, the term of this patent is extended or adjusted under 35 U.S.C. 154(b) by 0 days.

(21) Appl. No.: 17/111,409

(22) Filed: Dec. 3, 2020

(65) Prior Publication Data

US 2021/0176558 A1 Jun. 10, 2021

(30) Foreign Application Priority Data

Dec. 5, 2019 (CN) ..... 201911234583.3

(51) Int. Cl.
*H04R 1/10* (2006.01)
*H04R 1/40* (2006.01)

(52) U.S. Cl.
CPC ..... *H04R 1/1083* (2013.01); *H04R 1/406* (2013.01)

(58) Field of Classification Search
None
See application file for complete search history.

(56) References Cited

U.S. PATENT DOCUMENTS

2014/0086425 A1* 3/2014 Jensen ..... G10K 11/17817 381/71.11
2016/0192073 A1* 6/2016 Poornachandran ..... H04R 5/04 381/26
2016/0267899 A1 9/2016 Gauger, Jr. et al.
(Continued)

FOREIGN PATENT DOCUMENTS

CN 2256610 Y 6/1997
CN 104272380 A 1/2015
(Continued)

OTHER PUBLICATIONS

Miyahara Ryoji et al.: "A Hearing Device With an Adaptive Noise Canceller for Noise-Robust Voice Input", IEEE Transactions on Consumer Electronics, IEEE Service Center, New York, NY, US, vol. 65, No. 4, Nov. 1, 2019, (Nov. 1, 2019), pp. 444-453, XP011751599, ISSN: 0098-3063, DOI: 10.1109/TCE.2019.2941708.
(Continued)

*Primary Examiner* — James K Mooney
(74) *Attorney, Agent, or Firm* — Syncoda LLC; Feng Ma

(57) ABSTRACT

An earphone signal processing method includes: a signal picked up by a first microphone of an earphone at a position close to a mouth outside an ear canal, a signal picked up by a second microphone of the earphone at a position away from the mouth outside the ear canal and a signal picked up by a third microphone are acquired, the third microphone being in a cavity formed by the earphone and the ear canal; dual-microphone noise reduction is performed on the signals picked up by the first and second microphones to obtain a
(Continued)

first intermediate signal; dual-microphone noise reduction is performed on the signals picked up by the second and third microphones to obtain a second intermediate signal; the first and second intermediate signals are fused to obtain a fused voice signal; and the fused voice signal is output.

20 Claims, 4 Drawing Sheets

(56) References Cited

U.S. PATENT DOCUMENTS

| | | | |
|---|---|---|---|
| 2017/0249954 | A1 | 8/2017 | Kim |
| 2018/0012584 | A1 | 1/2018 | Gauger, Jr. et al. |
| 2018/0047381 | A1 | 2/2018 | Gauger, Jr. et al. |
| 2018/0343514 | A1* | 11/2018 | Dusan ..... G10K 11/17881 |
| 2019/0304429 | A1 | 10/2019 | Gauger, Jr. et al. |
| 2020/0107137 | A1* | 4/2020 | Koutrouli ..... H04R 25/407 |
| 2021/0065673 | A1 | 3/2021 | Gauger, Jr. et al. |

FOREIGN PATENT DOCUMENTS

| | | | |
|---|---|---|---|
| CN | 107889002 | A | 4/2018 |
| CN | 109121057 | A | 1/2019 |
| CN | 110139200 | A | 8/2019 |

OTHER PUBLICATIONS

Supplementary European Search Report in the European application No. 20211991.3, dated May 6, 2021.

* cited by examiner

EARPHONE SIGNAL PROCESSING METHOD AND SYSTEM, AND EARPHONE

CROSS-REFERENCE TO RELATED APPLICATION

This application claims priority to Chinese Patent Application No. 201911234583.3 filed on Dec. 5, 2019, the disclosure of which is hereby incorporated by reference in its entirety.

BACKGROUND

An earphone is usually provided with a microphone configured to collect a voice signal during a call of a user. A microphone of an existing earphone (particularly a wireless earphone) is usually arranged at an earplug position close to an ear and relatively far away from a mouth of the user, and consequently, the quality of a call voice collected by the microphone is not so ideal. Particularly when the user is in a loud-noise environment such as a metro, due to particularly loud noises, the voice quality of a call of the earphone is poor, and there is often such a condition that a user on the other side may not be heard clearly.

SUMMARY

The disclosure relates to the technical field of earphone noise reduction, and in particular to an earphone signal processing method and system, and an earphone.

According to a first aspect of the disclosure, embodiments of the disclosure provide an earphone signal processing method, which includes the following operations.

A signal picked up by a first microphone of an earphone at a position close to a mouth outside an ear canal, a signal picked up by a second microphone of the earphone at a position away from the mouth outside the ear canal and a signal picked up by a third microphone are acquired, and the third microphone is in a cavity formed by the earphone and the ear canal. Dual-microphone noise reduction is performed on the signal picked up by the first microphone and the signal picked up by the second microphone to obtain a first intermediate signal, and dual-microphone noise reduction is performed on the signal picked up by the second microphone and the signal picked up by the third microphone to obtain a second intermediate signal. The first intermediate signal and the second intermediate signal are fused to obtain a fused voice signal. The fused voice signal is output.

According to a second aspect of the disclosure, the embodiments of the disclosure provide an earphone signal processing system, which includes a first microphone signal acquisition unit, a second microphone signal acquisition unit, a third microphone signal acquisition unit, a first dual-microphone noise reduction unit, a second dual-microphone noise reduction unit, a fusion unit and an output unit.

The first microphone signal acquisition unit is configured to acquire a signal picked up by a first microphone of an earphone at a position close to a mouth outside an ear canal.

The second microphone signal acquisition unit is configured to acquire a signal picked up by a second microphone of the earphone at a position away from the mouth outside the ear canal.

The third microphone signal acquisition unit is configured to acquire a signal picked up by a third microphone of the earphone, the third microphone being in a cavity formed by the earphone and the ear canal.

The first dual-microphone noise reduction unit is configured to perform dual-microphone noise reduction on the signal picked up by the first microphone and the signal picked up by the second microphone to obtain a first intermediate signal.

The second dual-microphone noise reduction unit is configured to perform dual-microphone noise reduction on the signal picked up by the second microphone and the signal picked up by the third microphone to obtain a second intermediate signal.

The fusion unit is configured to fuse the first intermediate signal and the second intermediate signal to obtain a fused voice signal.

The output unit is configured to output the fused voice signal.

According to a third aspect of the disclosure, the embodiments of the disclosure provide an earphone, which includes a first microphone, a second microphone and a third microphone. The first microphone is at a position close to a mouth outside an ear canal. The second microphone is at a position away from the mouth outside the ear canal. The third microphone is in a cavity formed by the earphone and the ear canal. The abovementioned earphone signal processing system is arranged in the earphone.

DETAILED DESCRIPTION

Figure 1:
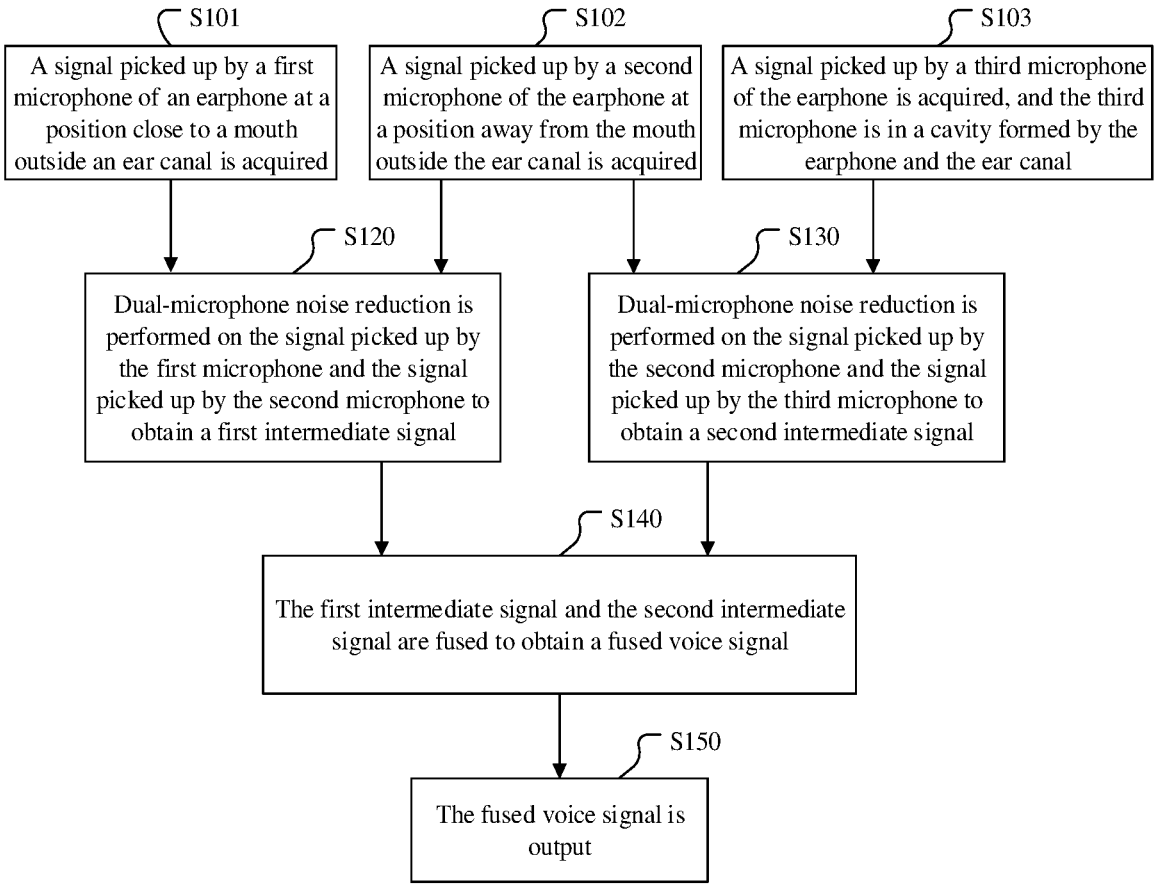
FIG. 1 is a flowchart of an earphone signal processing method according to an embodiment of the disclosure.

Embodiments of the disclosure provide an earphone signal processing method and system, and an earphone. For the problem of low SNR of an out-of-ear microphone during pickup in a loud-noise environment, pickup by an in-ear microphone is proposed. For the problems of relatively narrow band and lack of high-frequency information of the in-ear microphone, out-of-ear dual-microphone noise reduction is proposed to assist the in-ear microphone. For the problem that an external noise is picked up (or collected) by the in-ear microphone in the loud-noise environment, it is proposed to perform dual-microphone noise reduction on the in-ear microphone and the out-of-ear microphone. According to the solutions provided in the embodiments of the disclosure, the call quality of the earphone in the loud-noise environment may be improved. Detailed descriptions will be made below respectively.

In order to make the purpose, technical solutions and advantages of the disclosure clearer, the implementation modes of the disclosure will further be described below in combination with the drawings in detail. However, it should be understood that these descriptions are only exemplary and not intended to limit the scope of the disclosure. In addition, in the following descriptions, descriptions about known structures and technologies are omitted to avoid unnecessary confusion of concepts of the disclosure.

Terms are used herein not to limit the disclosure but only to describe specific embodiments. Terms "a/an", "one (kind)", "the" and the like used herein should also include meanings of "multiple" and "multiple kinds", unless otherwise clearly pointed out in the context. In addition, terms "include", "contain" and the like used herein represent existence of a feature, a step, an operation and/or a component but do not exclude existence or addition of one or more other features, steps, operations or components.

All the terms (including technical and scientific terms) used herein have meanings usually understood by those skilled in the art, unless otherwise specified. It is to be noted that the terms used herein should be explained to have meanings consistent with the context of the specification rather than explained ideally or excessively mechanically.

The drawings show some block diagrams and/or flowcharts. It should be understood that some blocks or combinations thereof in the block diagrams and/or the flowcharts may be implemented by computer program instructions. These computer program instructions may be provided for a universal computer, a dedicated computer or a processor of another programmable data processing device, such that these instructions may be executed by the processor to generate a device for realizing functions/operations described in these block diagrams and/or flowcharts.

Therefore, the technology of the disclosure may be implemented in form of hardware and/or software (including firmware and a microcode, etc.). In addition, the technology of the disclosure may adopt a form of a computer program product in a computer-readable storage medium storing instructions, and the computer program product may be used by an instruction execution system or used in combination with the instruction execution system. In the context of the disclosure, the computer-readable storage medium may be any medium capable of including, storing, transferring, propagating or transmitting instructions. For example, the computer-readable storage medium may include, but not limited to, an electric, magnetic, optical, electromagnetic, infrared or semiconductor system, device, apparatus or propagation medium. Specific examples of the computer-readable storage medium include a magnetic storage device such as a magnetic tape or a hard disk driver (HDD), an optical storage device such as a compact disc read-only memory (CD-ROM), a memory such as a random-access memory (RAM) or a flash memory, and/or a wired/wireless communication link.

For improving the quality of a call voice, single-microphone noise reduction or dual-microphone noise reduction may usually be implemented for the earphone. However, regardless of the single-microphone noise reduction or the dual-microphone noise reduction, a microphone is located outside an ear canal. For the single-microphone noise reduction, noise reduction processing is implemented by means of noise estimation, but it is limited by a distance between the microphone and the mouth. When the earphone is placed near the ear, a signal to noise ratio (SNR) thereof is relatively low, and the call quality in a noisy environment such as a metro is poor. For the dual-microphone noise reduction, a directional acoustic wave in a direction of the mouth of the user may be collected in a beamforming manner, but it is also limited by a distance between a primary microphone and the mouth, an included angle between a connecting line of two microphones and a connecting line of a center of the two microphones and the mouth, and a distance between the two microphones. A noise reduction effect achieved by it may be better than that of the single-microphone noise reduction, but the call quality is still not so good in the noisy environment such as the metro.

For an in-ear earphone, a relatively closed cavity may be formed in an ear canal after it is worn, a good effect of isolating an external acoustic environment may be achieved, and an external environmental noise is suppressed better. If the cavity is higher in tightness, the external acoustic environment may be isolated better, and the influence of the external noise including wind may be suppressed better. Similarly, for a circumaural or supra-aural earphone, the earphone may also form a relatively closed cavity with an ear canal after worn. When a person speaks, vibration of a vocal band is conducted to the cavity formed by the ear canal and an earphone front cavity through tissues such as bones and muscles. If the cavity is higher in tightness, an external noise signal is more unlikely to enter, and an in-ear voice signal is also more unlikely to leak to the outside, such that the signal obtained in the cavity is stronger. Therefore, compared with an external microphone, the in-ear microphone has a greater SNR. However, the in-ear voice signal is relatively narrow in band, includes no high-frequency information and sounds unnatural, and listening experience is relatively poor. Meanwhile, in the loud-noise environment, although the SNR of the in-ear microphone may be much greater than that of the external microphone, an external environmental noise leaking into the ear may still be picked up, thereby bringing influence to the listening experience.

Embodiments of the disclosure provide an earphone signal processing method.

FIG. 1 is a flowchart of an earphone signal processing method according to an embodiment of the disclosure. As illustrated in FIG. 1, the earphone signal processing method of the embodiment includes the following operations.

At S101, a signal picked up by a first microphone of an earphone at a position close to a mouth outside an ear canal is acquired.

At S102, a signal picked up by a second microphone of the earphone at a position away from the mouth outside the ear canal is acquired.

At S103, a signal picked up by a third microphone of the earphone is acquired, and the third microphone is in a cavity formed by the earphone and the ear canal.

It is to be noted that S101 to S103 are executed synchronously and signals picked up by the three microphones at the same time are acquired. The first microphone is a primary out-of-ear microphone, the second microphone is a secondary out-of-ear microphone, and the third microphone is an in-ear microphone. It is to be noted that the "in-ear microphone" mentioned here may refer to a microphone in the ear canal and may also be a microphone in the closed cavity formed by the ear canal and the earphone. No limits are made herein.

At S120, dual-microphone noise reduction is performed on the signal picked up by the first microphone and the signal picked up by the second microphone to obtain a first intermediate signal.

The primary and secondary out-of-ear microphones are at different positions near the ear, and voice parts and noise parts thereof are correlated. However, voice signal transmission functions (Hs) and noise signal transmission functions (Hn) of the two microphones are different because of different time differences of conduction of a human voice acoustic wave and a noise acoustic wave in another direction to the two microphones, and the noise parts in the microphones may be eliminated by use of a noise correlation without suppressing the voice parts. Therefore, compared with the signal picked up by any out-of-ear microphone, the first intermediate signal output after the dual-microphone noise reduction processing is performed on the first microphone and the second microphone has the advantage that an SNR is increased.

At S130, dual-microphone noise reduction is performed on the signal picked up by the second microphone and the signal picked up by the third microphone to obtain a second intermediate signal.

An out-of-ear signal is picked up by the second microphone, and an in-ear signal is picked up by the third microphone. An in-ear noise is transmitted from the outside, and in-ear and out-of-ear noises are correlated, namely a transmission function (H) from an out-of-ear noise signal to an in-ear noise signal exists. By use of such related information, a noise part in the in-ear microphone may be eliminated. Therefore, compared with the signal picked up by the third microphone, the second intermediate signal output after the dual-microphone noise reduction processing is performed on the second microphone and the third microphone has the advantage that an SNR is increased.

It is to be noted that operations S120 and S130 are executed independently and not execution premises of each other. The two operations may be executed concurrently, or they may be executed sequentially but execution results need to be output to the next operation together.

At S140, the first intermediate signal and the second intermediate signal are fused to obtain a fused voice signal.

Preferably, the fused voice signal includes a low-frequency part of the second intermediate signal and a medium-high frequency part of the first intermediate signal.

The first intermediate signal is calculated according to the out-of-ear microphones and includes more medium-high frequency information. The second intermediate signal is obtained by means of noise reduction according to the in-ear microphone, and an SNR of a low-frequency part thereof is relatively high. Therefore, in the fused voice signal obtained by fusing the first intermediate signal and the second intermediate signal, a low-frequency composition includes the low-frequency part of the second intermediate signal, such that a low-frequency SNR of the voice signal is increased; and a high-frequency composition includes the medium-high frequency part of the first intermediate signal, such that medium-high frequency information in the voice signal is enriched.

At S150, the fused voice signal is output.

The fused voice signal is output as an uplink signal.

From the above, according to the earphone signal processing method provided in the embodiment of the disclosure, the dual-microphone noise reduction is performed on the signal picked up by the first microphone and the signal picked up by the second microphone to obtain the first intermediate signal, and the first intermediate signal, compared with the signal picked up by the first microphone or the second microphone, has the advantage that the SNR is increased and may be adopted to assist the in-ear microphone in solving the problems of relatively narrow band and lack of high-frequency information of a signal thereof. The dual-microphone noise reduction is performed on the signal picked up by the second microphone and the signal picked up by the third microphone to obtain the second intermediate signal, and the second intermediate signal, compared with the signal picked up by the third microphone, has the advantages that the SNR is increased and the problem of pickup of an external noise by the in-ear microphone in a loud-noise environment may be solved. The fused voice signal obtained by fusing the first intermediate signal and the second intermediate signal not only includes the low-frequency part of the second intermediate signal but also includes the medium-high frequency part of the first intermediate signal, such that outputting the fused voice signal as the uplink signal increases the low-frequency SNR of the call voice signal, namely increasing the voice intelligibility, also enriches the medium-high frequency information of the voice signal, and increases the SNR of the medium-high frequency signal, thereby improving listening experience of a user. Therefore, compared with the conventional art, the solution of the embodiment of the disclosure has the advantage that the call quality of the earphone in the loud-noise environment may be improved.

S120 to S140 will be described below in detail.

In some preferred embodiments, at S120, the dual-microphone noise reduction is performed on the signal picked up by the first microphone and the signal picked up by the second microphone by use of beamforming processing.

That is, a spatial directivity is formed by use of a time difference of signal reception between the two microphones. From the prospective of an antenna pattern, in such a manner, an original omnidirectional reception pattern is changed to a lobe pattern with a zero point and a maximum directivity. A beam points to the direction of the mouth, namely voice signals sent from the direction of the mouth are received as much as possible, and meanwhile, noise signals in other directions are suppressed, such that the SNR of the voice signal of the user is increased.

Specifically, S120 includes the following operations.

A steering vector (S) for incidence of a human voice to the first microphone and the second microphone is obtained by use of a determined spatial relationship of the first microphone and the second microphone. The steering vector reflects a relative vector relationship between the voice signal picked up by the first microphone and the voice signal picked up by the second microphone, i.e., a relationship between relative amplitudes and relative phases of the voice signal picked up by the first microphone and the voice signal picked up by the second microphone. The steering vector may be measured in advance in a laboratory and used for subsequent processing as a known parameter.

In a pure noise period when a person does not speak, a covariance matrix $R_{NN}=XX^H$ of the first microphone and the second microphone is calculated and updated in real time. When the person speaks, $R_{NN}$ is stopped to be updated and adopts a previous latest value, where $X=[X1\ X2]^T$, X1 and X2 are frequency-domain signals of the first microphone and the second microphone respectively, and X is an input vector formed by the frequency-domain signals of the first microphone and the second microphone.

An inverse matrix $R_{NN}^{-1}$ of $R_{NN}$ is calculated, thereby calculating a real-time filter coefficient $$W = \frac{R_{NN}^{-1} S}{S^H R_{NN}^{-1} S}$$

of the first microphone and the second microphone according to the steering vector S and the inverse matrix $R_{NN}^{-1}$ and further obtaining an output $Y=W^H X$ after the dual-microphone noise reduction, where Y is the first intermediate signal.

It can thus be seen that the output first intermediate signal Y not only retains the human voice signal as much as possible but also suppresses the noise signals in the other directions, and compared with the out-of-ear signal picked up by the first microphone or the second microphone, has the advantage that the SNR is increased.

It is to be noted that the dual-microphone noise reduction may also be implemented by, but not limited to, an algorithm such as adaptive filtering, besides the abovementioned beamforming solution.

In some preferred embodiments, at S130, the dual-microphone noise reduction is performed on the signal picked up by the second microphone and the signal picked up by the third microphone by use of a normalized least mean square (NLMS) adaptive filtering algorithm.

An out-of-ear signal is picked up by the second microphone, and an in-ear signal is picked up by the third microphone. A noise in the in-ear signal is transmitted from the outside, and thus in-ear and out-of-ear noises are correlated, namely a transmission function (H) from an out-of-ear noise signal to an in-ear noise signal exists. By use of such related information, the noise part in the in-ear microphone may be eliminated.

Specifically, S130 includes the following operations.

Taking the signal picked up by the second microphone as a reference signal (ref) and taking the signal picked up by the third microphone as a target signal (des), in the pure noise period when the person does not speak, an optimal filter weight (w) is obtained by use of the NLMS adaptive filtering algorithm, and when the person speaks, a filter is stopped to be updated, and a filter weight adopts a previous latest value. Here, the filter corresponds to an impulse response of the transmission function (H) from the out-of-ear noise signal to the in-ear noise signal.

A noise part in the signal picked up by the third microphone is estimated according to a convolution result of the filter weight and the reference signal.

The noise part is subtracted from the signal picked up by the third microphone to obtain a voice signal after noise reduction (e), and the voice signal after noise reduction is the second intermediate signal.

It can thus be seen that, compared with the in-ear signal picked up by the third microphone, the second intermediate signal has the advantage that the SNR is increased.

It is to be noted that, at S120 and S130, a voice activity may be detected to determine whether the person is speaking. A voice activity detection method may usually include comparing signal power with a predetermined threshold, determining that the person is speaking when the signal power is greater than the threshold and determining that the person is not speaking when the signal power is less than the threshold. Since the SNR of the in-ear microphone is greater than that of the out-of-ear microphone, the in-ear microphone is more appropriate for detecting the voice activity. Of course, the voice activity may also be detected by use of other sensors.

In some preferred embodiments, the earphone signal processing method of the embodiments of the disclosure further includes: voice activity detection is performed by use of the third microphone to determine whether the person is speaking, and the dual-microphone noise reduction is executed in combination with a voice activity detection result.

The operation that the voice activity detection is performed by use of the third microphone to determine whether the person is speaking specifically includes: noise power of the signal picked up by the third microphone is estimated, an SNR of the signal is calculated, the SNR is compared with a predetermined SNR threshold, it is determined that the person is speaking when the SNR is greater than the threshold, and it is determined that the person is not speaking when the SNR is less than the threshold.

At S120 and S130, the voice activity detection result for determining whether the person is speaking is combined in a process of executing the dual-microphone noise reduction, specifically as follows.

In the process of executing the dual-microphone noise reduction on the signal picked up by the first microphone and the signal picked up by the second microphone, the voice activity detection is performed in real time by use of the third microphone to determine whether the person is speaking. In the pure noise period when it is determined that the person does not speak, the covariance matrix $R_{NN}=XX^H$ of the first microphone and the second microphone is calculated and updated in real time. When it is determined that the person is speaking, $R_{NN}$ is stopped to be updated and adopts the previous latest value.

In the process of executing the dual-microphone noise reduction on the signal picked up by the second microphone and the signal picked up by the third microphone, the voice activity detection is performed in real time by use of the third microphone to determine whether the person is speaking. In the pure noise period when it is determined that the person does not speak, the optimal filter weight is obtained by use of the NLMS adaptive filtering algorithm. When it is determined that the person is speaking, the filter is stopped to be updated, and the filter weight adopts the previous latest value.

For executing S140, namely for fusing the first intermediate signal and the second intermediate signal to obtain the fused voice signal, the fused voice signal includes the low-frequency part of the second intermediate signal and the medium-high frequency part of the first intermediate signal, and the following three fusion manners are provided in the embodiment of the disclosure.

In a first fusion manner, the medium-high frequency part of the first intermediate signal and the low-frequency part of the second intermediate signal are extracted based on a predetermined dividing frequency respectively, and two extracted signals are combined directly.

In a second fusion manner, low-frequency parts and medium-high frequency parts of the first intermediate signal and the second intermediate signal are extracted based on the predetermined dividing frequency respectively, weighted fusion is performed on the low-frequency parts of the first intermediate signal and the second intermediate signal and on the medium-high frequency parts of the first intermediate signal and the second intermediate signal according to different weights, and weighted results of the two parts are combined to obtain the fused voice signal.

A frequency range of the voice signal is 300 Hz to 3.4 kHz. The predetermined dividing frequency may adopt, for example, 1 kHz, and the low-frequency parts lower than 1 kHz and the medium-high frequency parts greater than 1 kHz are extracted from the first intermediate signal and the second intermediate signal respectively. Weighted fusion is performed on the first intermediate signal and the second intermediate signal lower than 1 kHz, weighted fusion is performed on the first intermediate signal and the second intermediate signal greater than 1 kHz according to different weights, and the weighted results of the two parts are combined to obtain the fused voice signal.

A basic formula for weighted fusion may be expressed as $C=\alpha*Y+\beta*Z$, where C is the fused voice signal, Y is the first intermediate signal, Z is the second intermediate signal, both $\alpha$ and $\beta$ are fusion weights greater than or equal to 0, and $\alpha+\beta=1$.

A weighted fusion formula of the embodiment may be expressed as $C=(\alpha1*Y1+\beta1*Z1)+(\alpha2*Y2+\beta2*Z2)$, where C is the fused voice signal, Y1 and Y2 correspond to the low-frequency part and the medium-high frequency part of the first intermediate signal, Z1 and Z2 correspond to the low-frequency part and the medium-high frequency part of the second intermediate signal, $\alpha 1$ and $\beta 1$ are fusion weights of the low-frequency parts, $\alpha 2$ and $\beta 2$ are fusion weights of the medium-high frequency parts, $\alpha 1+\beta 1=1$, and $\alpha 2+\beta 2=1$.

Since the low-frequency part of the acquired second intermediate signal has a relatively high SNR and may ensure the intelligibility of the call voice, the weight $\beta 1$ needs to be greater than the weight $\alpha 1$ during fusion, for example, $\alpha=0.1$ and $\beta 1=0.9$. Since the acquired first intermediate signal includes rich medium-high frequency information and may be adopted to improve the listening experience of the user, the weight $\alpha 2$ needs to be greater than the weight $\beta 2$ during fusion, for example, $\alpha 2=0.9$ and $\beta 2=0.1$.

During a practical application, for simplifying a fusion process, only the low-frequency part of the second intermediate signal and the medium-high frequency part of the first intermediate signal are extracted, and the two parts are combined to obtain the fused voice signal. In such case, the fusion weights in the weighted fusion formula are correspondingly as follows: $\alpha 1=0$, $\beta 1=1$, $\alpha 2=1$ and $\beta 2=0$, and a simplified fusion formula is $C=Z1+Y2$, where Y2 is the medium-high frequency part of the first intermediate signal, and Z1 is the low-frequency part of the second intermediate signal. Therefore, the first fusion manner may be considered as a particular case of the second fusion manner.

In a third fusion manner, the first intermediate signal and the second intermediate signal are correspondingly divided to multiple sub bands, weighted fusion is performed on the first intermediate signal and the second intermediate signal in each sub band according to different weights, and weighted results of each sub band are combined to obtain the fused voice signal.

The third fusion manner is substantially an extension of the second fusion manner. In the second fusion manner, the first intermediate signal and the second intermediate signal are divided into low-frequency and medium-high frequency bands respectively. In the third fusion manner, the first intermediate signal and the second intermediate signal are divided into more than two frequency bands, and each frequency band corresponds to a sub band. Fusion is independently performed in each sub band. For each sub band signal, the weighted fusion is performed on the first intermediate signal and the second intermediate signal according to different weights, and then the weighted results of each sub band are combined to obtain the fused voice signal.

It is to be noted that, in the second and third fusion manners, the fusion weights of the first intermediate signal and the second intermediate signal in different frequency bands (sub bands) may be predetermined, the weight of the second intermediate signal is greater during low-frequency fusion, and the weight of the first intermediate signal is greater during medium-high frequency fusion. It is easy to understand that the fusion weight may also be adaptively adjusted according to an environmental change, the weight of the first intermediate signal during the low-frequency fusion is increased when a sound pressure level is low, and the weight of the second intermediate signal during the low-frequency fusion is increased when the sound pressure level is high. Therefore, more accurate fusion may be implemented to achieve higher sound quality.

This is because: when the sound pressure level is low, the SNR of the first intermediate signal is also greater, the intelligibility is high enough, the first intermediate signal is calculated according to the out-of-ear microphones and sounds more natural, and in such case, increasing the weight of the first intermediate signal during the low-frequency fusion may provide a better listening experience. When the sound pressure level is high, the SNR of the low-frequency part of the first intermediate signal is low, the intelligibility of the voice is low, while the SNR of the low-frequency part of the second intermediate signal is greater, and in such case, increasing the weight of the second intermediate signal during the low-frequency fusion may improve the intelligibility of the voice. Therefore, determining a magnitude of an environmental noise according to the sound pressure level and further adaptively adjusting the weight of the first intermediate signal or the second intermediate signal during the low-frequency fusion may implement more intelligent fusion and balance the listening experience and the intelligibility better in different noise environments.

It is easy to understand that the earphone usually includes a speaker and the speaker is configured to play a downlink (i.e., a transmission path of a voice of the other side during a call) signal. During the call, the third microphone in the cavity formed by the earphone and the ear canal may pick up a sound of the speaker. Therefore, for avoiding interference, it is necessary to perform acoustic echo cancellation (AEC) processing on the third microphone.

An echo is produced when an acoustic signal is sent through the speaker for the downlink (i.e., the transmission path of the voice of the other side during the call) call signal and then fed to the microphone. An echo part in the microphone is correlated with the downlink signal, namely a transmission function (H) from a downlink signal to a microphone echo signal exists. By use of such related information, echo information in the microphone may be estimated through the downlink signal, thereby removing the echo part in the microphone.

In some preferred embodiments, the earphone signal processing method provided in the embodiment of the disclosure further includes: AEC processing is executed on the signal picked up by the third microphone.

Similar to a manner for acquiring the second intermediate signal, the AEC processing may also be executed on the signal picked up by the third microphone by use of the NLMS adaptive filtering algorithm. Specifically, taking the signal picked up by the third microphone as a target signal (des) and taking the downlink signal as a reference signal (ref), an optimal filter weight is obtained by use of the NLMS adaptive filtering algorithm. In such case, the filter corresponds to an impulse response of the transmission function (H) from the downlink signal to the microphone echo signal.

An echo part in the signal picked up by the third microphone is estimated according to a convolution result of the filter weight and the reference signal.

The echo part is subtracted from the signal picked up by the third microphone to obtain an echo-canceled signal, and the echo-canceled signal is determined as the signal picked up by the third microphone.

After the AEC processing, the echo part in the signal picked up by the third microphone is eliminated, and interferences to subsequent noise reduction processing are avoided.

Figure 2:
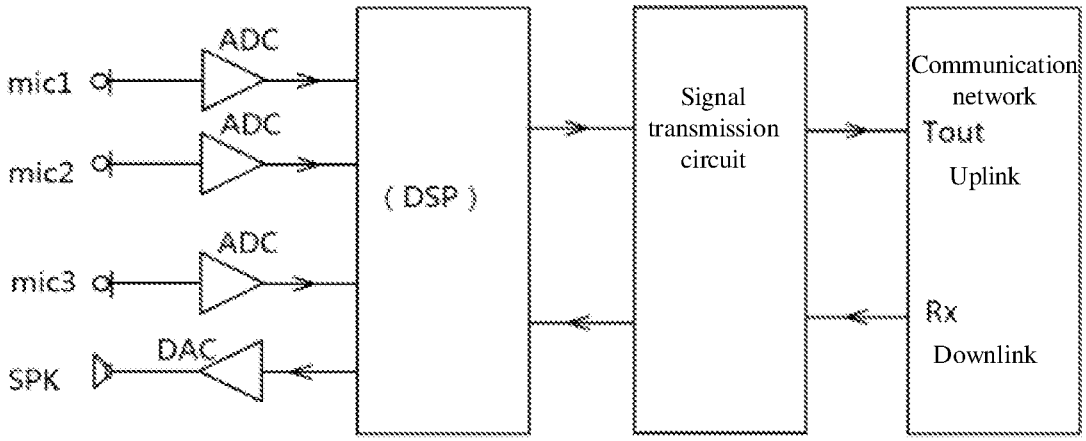
FIG. 2 is a diagram of computer programs for an earphone signal processing method according to an embodiment of the disclosure.

It is to be noted that the AEC processing is after S103 and before S130 in FIG. 2. That is, if the earphone also includes the speaker, after the signal picked up by the in-ear microphone is acquired, it is necessary to perform the AEC processing on the in-ear microphone in real time to eliminate the echo part in the signal picked up by the in-ear microphone to avoid the interferences to subsequent noise reduction processing.

Optionally, before the fused voice signal is output as the uplink signal (a voice signal sent by the local side to the other side during the call) in S150, an operation that single-channel noise reduction processing is performed on the fused voice signal may further be included to further improve the SNR of the uplink signal. The noise reduction processing method is similar to single-microphone noise reduction. Common methods include Wiener filtering, Kalman filtering and the like.

Finally, it is also to be noted that all S120 to S140 may be executed in a frequency domain. After the signals picked up by the three microphones are acquired, corresponding digital signals are obtained by analog to digital conversion (ADC), and then the digital signals are converted from a time domain to the frequency domain. When the earphone includes the speaker, the downlink signal during the call also needs to be converted to the frequency domain.

FIG. 2 is a diagram of computer programs for an earphone signal processing method according to an embodiment of the disclosure. As illustrated in FIG. 2, a first microphone and a second microphone are in an external environment of an ear canal, and a third microphone and a speaker are in a cavity formed by an earphone and the ear canal. Signals picked up by the three microphones are acquired, converted to corresponding digital signals by ADC, and input to a digital signal processor (DSP). The DSP, after performing noise reduction and fusion processing on the digital signals of the three microphones, sends a fusion result to a signal transmission circuit. The signal transmission circuit sends the fusion result to an uplink of a communication network as an uplink signal $T_{out}$. During a call, a downlink signal $R_x$ of the communication network is transmitted to the DSP through the signal transmission circuit, the DSP performs AEC processing on the digital signal of the third microphone according to the downlink signal $R_x$ and simultaneously outputs the downlink signal $R_x$, and $R_x$ is converted to a corresponding analog signal by digital to analog conversion (DAC) for the speaker to play.

Therefore, the earphone signal processing method provided in the embodiment of the disclosure may be implemented through computer program instructions. These computer program instructions are provided for a DSP chip, and the DSP chip processes these computer program instructions.

The embodiments of the disclosure also provide an earphone signal processing system.

Figure 3:
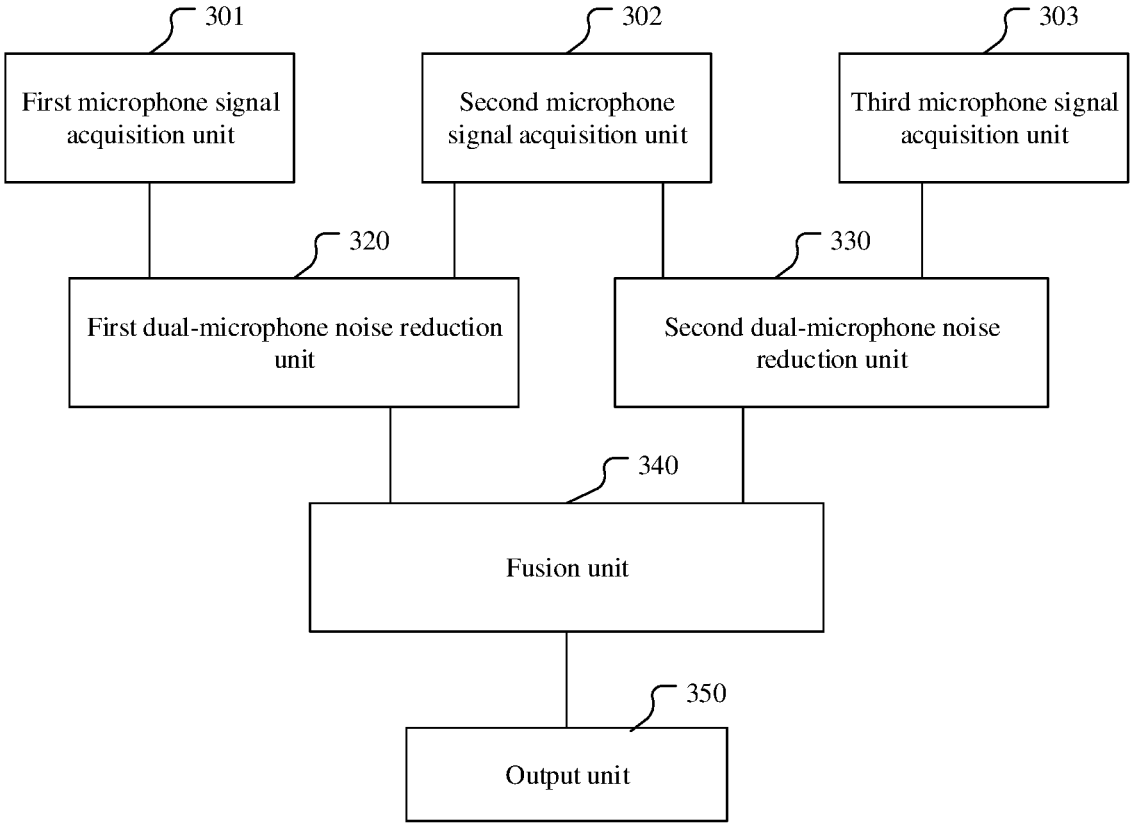
FIG. 3 is a structure diagram of an earphone signal processing system according to an embodiment of the disclosure.

FIG. 3 is a structure diagram of an earphone signal processing system according to an embodiment of the disclosure. As illustrated in FIG. 3, the earphone signal processing system of the embodiment includes a first microphone signal acquisition unit 301, a second microphone signal acquisition unit 302, a third microphone signal acquisition unit 303, a first dual-microphone noise reduction unit 320, a second dual-microphone noise reduction unit 330, a fusion unit 340 and an output unit 350.

The first microphone signal acquisition unit 301 is configured to acquire a signal picked up by a first microphone of an earphone at a position close to a mouth outside an ear canal.

The second microphone signal acquisition unit 302 is configured to acquire a signal picked up by a second microphone of the earphone at a position away from the mouth outside the ear canal.

The third microphone signal acquisition unit 303 is configured to acquire a signal picked up by a third microphone of the earphone, and the third microphone is in a cavity formed by the earphone and the ear canal.

The first dual-microphone noise reduction unit 320 is configured to perform dual-microphone noise reduction on the signal picked up by the first microphone and the signal picked up by the second microphone to obtain a first intermediate signal.

The second dual-microphone noise reduction unit 330 is configured to perform dual-microphone noise reduction on the signal picked up by the second microphone and the signal picked up by the third microphone to obtain a second intermediate signal.

The fusion unit 340 is configured to perform weighted fusion on the first intermediate signal and the second intermediate signal to obtain a fused voice signal.

The output unit 350 is configured to output the fused voice signal.

In some preferred embodiments, the first dual-microphone noise reduction unit 320 is configured to execute the dual-microphone noise reduction on the signal picked up by the first microphone and the signal picked up by the second microphone by use of beamforming processing, which specifically includes: a steering vector S is obtained by use of a determined spatial relationship of the first microphone and the second microphone; in a pure noise period when a person does not speak, a covariance matrix $R_{NN}=XX^H$ of the first microphone and the second microphone is calculated and updated in real time; when the person speaks, $R_{NN}$ is stopped to be updated and adopts a previous latest value, where $X=[X1\ X2]^T$, X1 and X2 are frequency-domain signals of the first microphone and the second microphone respectively, and X is an input vector formed by the frequency-domain signals of the first microphone and the second microphone; and an inverse matrix $R_{NN}^{-1}$ of $R_{NN}$ is calculated, thereby calculating a real-time filter coefficient $$W = \frac{R_{NN}^{-1} S}{S^H R_{NN}^{-1} S}$$

of the first microphone and the second microphone according to the steering vector S and the inverse matrix $R_{NN}^{-1}$ and further obtaining an output $Y=W^HX$ after the dual-microphone noise reduction, where Y is the first intermediate signal.

In some preferred embodiments, the second dual-microphone noise reduction unit 330 is configured to execute the dual-microphone noise reduction on the signal picked up by the second microphone and the signal picked up by the third microphone by use of an NLMS adaptive filtering algorithm, which specifically includes: taking the signal picked up by the second microphone as a reference signal and taking the signal picked up by the third microphone as a target signal, in the pure noise period when the person does not speak, an optimal filter weight is obtained by use of the NLMS adaptive filtering algorithm, and when the person speaks, a filter is stopped to be updated, and a filter weight adopts a previous latest value; a noise part in the signal picked up by the third microphone is estimated according to a convolution result of the filter weight and the reference signal; and the noise part is subtracted from the signal picked up by the third microphone to obtain a voice signal after noise reduction, and the voice signal after noise reduction is the second intermediate signal.

Preferably, a composition of the fused voice signal obtained by fusing the first intermediate signal and the second intermediate signal mainly includes a medium-high frequency part of the first intermediate signal and a low-frequency part of the second intermediate signal. In some preferred embodiments, the fusion unit 340 is specifically configured to:

extract the medium-high frequency part of the first intermediate signal and the low-frequency part of the second intermediate signal based on a predetermined dividing frequency respectively, and combine two extracted signals directly; or extract low-frequency parts and medium-high frequency parts of the first intermediate signal and the second intermediate signal based on the predetermined dividing frequency respectively, perform weighted fusion on the first intermediate signal and the second intermediate signal in the low-frequency parts and on the first intermediate signal and the second intermediate signal in the medium-high frequency parts according to different weights, and combine weighted results of the two parts to obtain the fused voice signal; or correspondingly divide the first intermediate signal and the second intermediate signal to multiple sub bands, perform weighted fusion on the first intermediate signal and the second intermediate signal in each sub band according to different weights, and combine weighted results of each sub band to obtain the fused voice signal.

During the weighted fusion, the fusion weights of the first intermediate signal and the second intermediate signal are predetermined, the weight of the second intermediate signal is greater during low-frequency fusion, and the weight of the first intermediate signal is greater during medium-high frequency fusion.

Or, during the weighted fusion, the fusion weights of the first intermediate signal and the second intermediate signal are adaptively adjusted according to acoustic environment, the weight of the first intermediate signal during the low-frequency fusion is increased when a sound pressure level is low, and the weight of the second intermediate signal during the low-frequency fusion is increased when the sound pressure level is high.

In some preferred embodiments, the earphone signal processing system of the embodiment of the disclosure further includes a voice activity detection module, configured to perform voice activity detection by use of the third microphone to determine whether the person is speaking and execute the dual-microphone noise reduction in combination with a voice activity detection result. The operation that the voice activity detection module performs the voice activity detection by use of the third microphone to determine whether the person is speaking specifically includes the following operations.

Noise power of the signal picked up by the third microphone is estimated, an SNR of the signal is calculated, the SNR is compared with a predetermined SNR threshold, it is determined that the person is speaking when the SNR is greater than the threshold, and it is determined that the person is not speaking when the SNR is less than the threshold.

When the structure is designed, two voice activity detection modules are arranged in the first dual-microphone noise reduction unit 320 and the second dual-microphone noise reduction unit 330 respectively, or only one common voice activity detection module is arranged outside the two dual-microphone noise reduction units. An input end of the voice activity detection module is connected with an output end of the third microphone signal acquisition unit 303, while an output end is connected with the first dual-microphone noise reduction unit 320 and the second dual-microphone noise reduction unit 330 respectively.

Optionally, the earphone further includes a speaker. The speaker is configured to play a downlink signal. The signal picked up by the third microphone during the call includes the signal played by the speaker.

In some preferred embodiments, the earphone signal processing system of the embodiment of the disclosure further includes an AEC module, configured to execute AEC processing on the signal picked up by the third microphone. The AEC module is specifically configured to, taking the signal picked up by the third microphone as a target signal and taking the downlink signal as a reference signal, obtain an optimal filter weight by use of the NLMS adaptive filtering algorithm; estimate an echo part in the signal picked up by the third microphone according to a convolution result of the filter weight and the reference signal; and subtract the echo part from the signal picked up by the third microphone to obtain an echo-canceled signal and determine the echo-canceled signal as the signal picked up by the third microphone.

When the structure is designed, the AEC module may be arranged in the third microphone signal acquisition unit 303, and may also be arranged outside the third microphone signal acquisition unit 303. In such case, one of two input ends of the AEC module is connected with a signal output end of the third microphone, while the other is connected with a signal input end of the speaker of the earphone, and an output end is connected with an output end of the third microphone signal acquisition unit 303.

The system embodiment substantially corresponds to the method embodiment and thus related parts refer to part of the descriptions about the method embodiment. The above system embodiment is only schematic. The units described as separate parts may or may not be physically separated, and namely may be located in the same place, or may also be distributed to multiple units. Part or all of the modules may be selected to achieve the purpose of the solutions of the embodiments according to a practical requirement. Those skilled in the art can understood and implement the disclosure without creative work.

The embodiments of the disclosure also provide an earphone.

Figure 4:
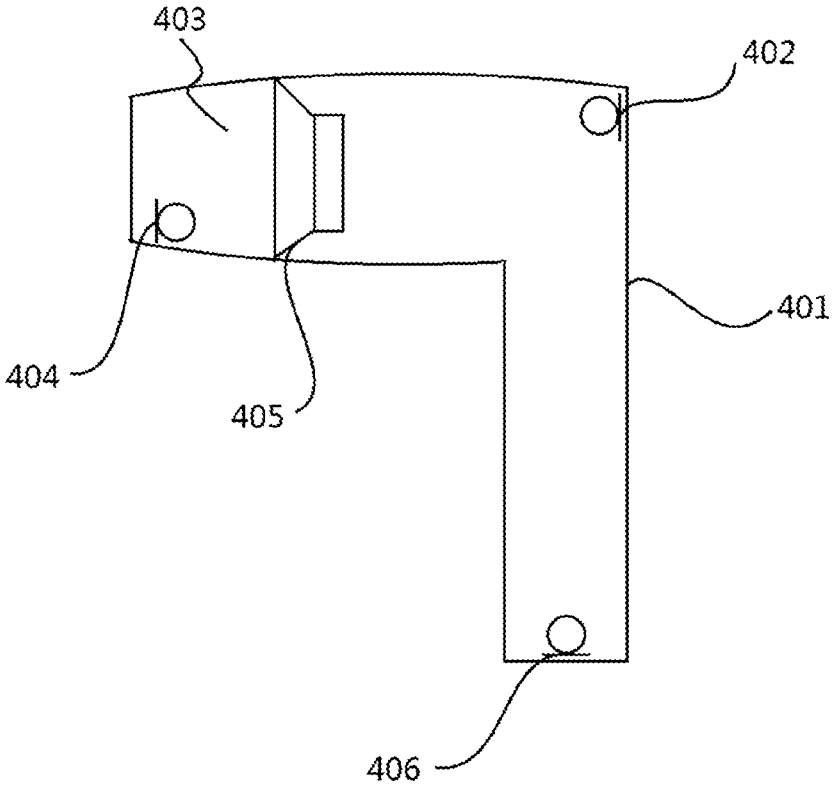
FIG. 4 is a structure diagram of an earphone according to an embodiment of the disclosure.

FIG. 4 is a structure diagram of an earphone according to an embodiment of the disclosure. As illustrated in FIG. 4, the earphone provided in the embodiment of the disclosure includes a shell 401. A first microphone 406, a second microphone 402 and a third microphone 404 are arranged in the shell 401. The first microphone 406 is at a position close to a mouth outside an ear canal, the second microphone 402 is at a position away from the mouth outside the ear canal, and the third microphone 404 is in a cavity formed by the earphone and the ear canal. Optionally, a speaker 405 is also arranged in the shell 401. The speaker 405 and an in-ear part of the shell 401 enclose an earphone front cavity 403. The third microphone 404 is in the earphone front cavity 403. A signal picked up by the third microphone 404 during a call includes a signal played by the speaker 405. For improving the call quality in a loud-noise environment, the earphone signal processing system of the abovementioned embodiment of the disclosure is arranged in the shell of the earphone.

The earphone may be a wireless earphone and may also be a wired earphone. It can be understood that the earphone signal processing method and system provided in the embodiments of the disclosure may not only be applied to an in-ear earphone but also be applied to a headphone.

The above is only the specific implementation mode of the disclosure. Under the teaching of the disclosure, those skilled in the art may make other improvements or transformations based on the embodiments. Those skilled in the art should know that the above specific descriptions are made only for the purpose of explaining the disclosure better and the scope of protection of the disclosure should be subject to the scope of protection of the claims.

At A1, an earphone signal processing method includes:

acquiring a signal picked up by a first microphone of an earphone at a position close to a mouth outside an ear canal, a signal picked up by a second microphone of the earphone at a position away from the mouth outside the ear canal and a signal picked up by a third microphone of the earphone, the third microphone being in a cavity formed by the earphone and the ear canal;

performing dual-microphone noise reduction on the signal picked up by the first microphone and the signal picked up by the second microphone to obtain a first intermediate signal, and performing dual-microphone noise reduction on the signal picked up by the second microphone and the signal picked up by the third microphone to obtain a second intermediate signal;

fusing the first intermediate signal and the second intermediate signal to obtain a fused voice signal; and outputting the fused voice signal.

At A2, for the earphone signal processing method of A1, the operation of performing the dual-microphone noise reduction on the signal picked up by the first microphone and the signal picked up by the second microphone to obtain the first intermediate signal includes:

executing the dual-microphone noise reduction on the signal picked up by the first microphone and the signal picked up by the second microphone by use of beamforming processing.

At A3, fot the earphone signal processing method of A1, the operation of performing the dual-microphone noise reduction on the signal picked up by the second microphone and the signal picked up by the third microphone to obtain the second intermediate signal includes:

executing the dual-microphone noise reduction on the signal picked up by the second microphone and the signal picked up by the third microphone by use of a normalized least mean square (NLMS) adaptive filtering algorithm.

At A4, fot the earphone signal processing method of A1, the fused voice signal includes a low-frequency part of the second intermediate signal and a medium-high frequency part of the first intermediate signal.

At A5, fot the earphone signal processing method of A4, the operation of fusing the first intermediate signal and the second intermediate signal to obtain the fused voice signal includes:

extracting the medium-high frequency part of the first intermediate signal and the low-frequency part of the second intermediate signal based on a predetermined dividing frequency respectively, and directly combining two extracted signals directly; or extracting low-frequency parts and medium-high frequency parts of the first intermediate signal and the second intermediate signal based on the predetermined dividing frequency respectively, performing weighted fusion on the first intermediate signal and the second intermediate signal in the low-frequency parts and on the first intermediate signal and the second intermediate signal in the medium-high frequency parts according to different weights, and combining weighted results of the two parts to obtain the fused voice signal; or correspondingly dividing the first intermediate signal and the second intermediate signal to multiple sub bands, performing weighted fusion on the first intermediate signal and the second intermediate signal in each sub band according to different weights, and combining weighted results of each sub band to obtain the fused voice signal.

At A6, fot the earphone signal processing method of A5, the weights for the weighted fusion are predetermined, the weight of the second intermediate signal is greater during low-frequency fusion, and the weight of the first intermediate signal is greater during medium-high frequency fusion; or the weights for the weighted fusion are adaptively adjusted according to acoustic environment, the weight of the first intermediate signal during the low-frequency fusion is increased in response to a sound pressure level being low, and the weight of the second intermediate signal during the low-frequency fusion is increased in response to the sound pressure level being high.

At A7, fot the earphone signal processing method of A1 to A6, the earphone further includes a speaker, the speaker is configured to play a downlink signal, and the signal picked up by the third microphone during a call includes the signal played by the speaker; and the earphone signal processing method further includes:

executing acoustic echo cancellation (AEC) processing on the signal picked up by the third microphone.

At A8, fot the earphone signal processing method of A7, the operation of executing the AEC processing on the signal picked up by the third microphone includes:

taking the signal picked up by the third microphone as a target signal and taking the downlink signal as a reference signal, obtaining an optimal filter weight by use of the NLMS adaptive filtering algorithm;

estimating an echo part in the signal picked up by the third microphone according to a convolution result of the filter weight and the reference signal; and subtracting the echo part from the signal picked up by the third microphone to obtain an echo-canceled signal, and determining the echo-canceled signal as the signal picked up by the third microphone.

At A9, the earphone signal processing method of claims A1 to A6 further includes: performing voice activity detection by use of the third microphone to determine whether a person is speaking, and executing the dual-microphone noise reduction in combination with a voice activity detection result.

At A10, fot the earphone signal processing method of A9, the operation of performing the voice activity detection by use of the third microphone to determine whether the person is speaking specifically includes:

estimating noise power of the signal picked up by the third microphone, calculating a signal to noise ratio (SNR) of the signal, comparing the SNR with a predetermined SNR threshold, determining that the person is speaking when the SNR is greater than the threshold, and determining that the person is not speaking when the SNR is less than the threshold.

At B11, an earphone signal processing system includes:

a first microphone signal acquisition unit, configured to acquire a signal picked up by a first microphone of an earphone at a position close to a mouth outside an ear canal;

a second microphone signal acquisition unit, configured to acquire a signal picked up by a second microphone of the earphone at a position away from the mouth outside the ear canal;

a third microphone signal acquisition unit, configured to acquire a signal picked up by a third microphone of the earphone, the third microphone being in a cavity formed by the earphone and the ear canal;

a first dual-microphone noise reduction unit, configured to perform dual-microphone noise reduction on the signal picked up by the first microphone and the signal picked up by the second microphone to obtain a first intermediate signal;

a second dual-microphone noise reduction unit, configured to perform dual-microphone noise reduction on the signal picked up by the second microphone and the signal picked up by the third microphone to obtain a second intermediate signal;

a fusion unit, configured to fuse the first intermediate signal and the second intermediate signal to obtain a fused voice signal; and an output unit, configured to output the fused voice signal.

At B12, fot the earphone signal processing system of B11, the first dual-microphone noise reduction unit is configured to execute the dual-microphone noise reduction on the signal picked up by the first microphone and the signal picked up by the second microphone by use of beamforming processing.

At B13, fot the earphone signal processing system of B11, the second dual-microphone noise reduction unit is configured to execute the dual-microphone noise reduction on the signal picked up by the second microphone and the signal picked up by the third microphone by use of a normalized least mean square (NLMS) adaptive filtering algorithm.

At B14, fot the earphone signal processing system of B11, the fused voice signal includes a low-frequency part of the second intermediate signal and a medium-high frequency part of the first intermediate signal.

At B15, fot the earphone signal processing system of claim B14, the fusion unit is specifically configured to:

extract the medium-high frequency part of the first intermediate signal and the low-frequency part of the second intermediate signal based on a predetermined dividing frequency respectively, and combine two extracted signals directly; or extract low-frequency parts and medium-high frequency parts of the first intermediate signal and the second intermediate signal based on the predetermined dividing frequency respectively, perform weighted fusion on the first intermediate signal and the second intermediate signal in the low-frequency parts and on the first intermediate signal and the second intermediate signal in the medium-high frequency parts according to different weights, and combine weighted results of the two parts to obtain the fused voice signal; or correspondingly divide the first intermediate signal and the second intermediate signal to multiple sub bands, perform weighted fusion on the first intermediate signal and the second intermediate signal in each sub band according to different weights, and combine weighted results of each sub band to obtain the fused voice signal.

At B16, fot the earphone signal processing system of B15, the weights for the weighted fusion are predetermined, the weight of the second intermediate signal is greater during low-frequency fusion, and the weight of the first intermediate signal is greater during medium-high frequency fusion; or the weights for the weighted fusion are adaptively adjusted according to acoustic environment, the weight of the first intermediate signal during the low-frequency fusion is increased in response to a sound pressure level being low, and the weight of the second intermediate signal during the low-frequency fusion is increased in response to the sound pressure level being high.

At B17, fot the earphone signal processing system of B11 to B16, the earphone further includes a speaker, the speaker is configured to play a downlink signal, and the signal picked up by the third microphone during a call includes the signal played by the speaker; and the earphone signal processing system further includes an acoustic echo cancellation (AEC) module, configured to execute AEC processing on the signal picked up by the third microphone.

At B18, fot the earphone signal processing system of B17, the AEC module is specifically configured to:

take the signal picked up by the third microphone as a target signal, take the downlink signal as a reference signal, obtain an optimal filter weight by use of the NLMS adaptive filtering algorithm;

estimate an echo part in the signal picked up by the third microphone according to a convolution result of the filter weight and the reference signal; and subtract the echo part from the signal picked up by the third microphone to obtain an echo-canceled signal and determine the echo-canceled signal as the signal picked up by the third microphone.

At B19, the earphone signal processing system of B11 to B16 further includes a voice activity detection module, configured to perform voice activity detection by use of the third microphone to determine whether a person is speaking, and execute the dual-microphone noise reduction in combination with a voice activity detection result.

At B20, fot the earphone signal processing system of B19, the voice activity detection module is specifically configured, in response to performing the voice activity detection by use of the third microphone to determine whether the person is speaking, to:

estimate noise power of the signal picked up by the third microphone, calculate a signal to noise ratio (SNR) of the signal, compare the SNR with a predetermined SNR threshold, determine that the person is speaking when the SNR is greater than the threshold, and determine that the person is not speaking when the SNR is less than the threshold.

At C21, an earphone includes a first microphone, a second microphone and a third microphone, the first microphone is at a position close to a mouth outside an ear canal, the second microphone is at a position away from the mouth outside the ear canal, and the third microphone is in a cavity formed by the earphone and the ear canal; and the earphone signal processing system of B11 to B20 is arranged in the earphone.

What is claimed is:

1. An earphone signal processing method, comprising:

acquiring a signal picked up by a first microphone of an earphone at a position close to a mouth outside an ear canal, a signal picked up by a second microphone of the earphone at a position away from the mouth outside the ear canal and a signal picked up by a third microphone of the earphone, the third microphone being in a cavity formed by the earphone and the ear canal;

performing dual-microphone noise reduction on the signal picked up by the first microphone and the signal picked up by the second microphone to obtain a first intermediate signal, and performing dual-microphone noise reduction on the signal picked up by the second microphone and the signal picked up by the third microphone to obtain a second intermediate signal;

fusing the first intermediate signal and the second intermediate signal to obtain a fused voice signal; and outputting the fused voice signal.

2. The earphone signal processing method of claim 1, wherein performing the dual-microphone noise reduction on the signal picked up by the first microphone and the signal picked up by the second microphone to obtain the first intermediate signal comprises:

executing the dual-microphone noise reduction on the signal picked up by the first microphone and the signal picked up by the second microphone by use of beamforming processing.

3. The earphone signal processing method of claim 1, wherein performing the dual-microphone noise reduction on the signal picked up by the second microphone and the signal picked up by the third microphone to obtain the second intermediate signal comprises:

executing the dual-microphone noise reduction on the signal picked up by the second microphone and the signal picked up by the third microphone by use of a normalized least mean square (NLMS) adaptive filtering algorithm.

4. The earphone signal processing method of claim 1, wherein the fused voice signal comprises a low-frequency part of the second intermediate signal and a medium-high frequency part of the first intermediate signal.

5. The earphone signal processing method of claim 4, wherein fusing the first intermediate signal and the second intermediate signal to obtain the fused voice signal comprises:

extracting the medium-high frequency part of the first intermediate signal and the low-frequency part of the second intermediate signal based on a predetermined dividing frequency respectively, and combining two extracted signals directly; or extracting low-frequency parts and medium-high frequency parts of the first intermediate signal and the second intermediate signal based on the predetermined dividing frequency respectively, performing weighted fusion on the first intermediate signal and the second intermediate signal in the low-frequency parts and on the first intermediate signal and the second intermediate signal in the medium-high frequency parts according to different weights, and combining weighted results of the two parts to obtain the fused voice signal; or correspondingly dividing the first intermediate signal and the second intermediate signal to multiple sub bands, performing weighted fusion on the first intermediate signal and the second intermediate signal in each sub band according to different weights, and combining weighted results of each sub band to obtain the fused voice signal.

6. The earphone signal processing method of claim 5, wherein the weights for the weighted fusion are predetermined, wherein the weight of the second intermediate signal is greater during low-frequency fusion, and the weight of the first intermediate signal is greater during medium-high frequency fusion; or the weights for the weighted fusion are adaptively adjusted according to acoustic environment, wherein the weight of the first intermediate signal during the low-frequency fusion is increased in response to a sound pressure level being low, and the weight of the second intermediate signal during the low-frequency fusion is increased in response to the sound pressure level being high.

7. The earphone signal processing method of claim 1, further comprising:

executing acoustic echo cancellation (AEC) processing on the signal picked up by the third microphone.

8. The earphone signal processing method of claim 7, wherein executing the AEC processing on the signal picked up by the third microphone comprises:

taking the signal picked up by the third microphone as a target signal and taking a downlink signal as a reference signal, obtaining an optimal filter weight by use of a normalized least mean square (NLMS) adaptive filtering algorithm;

estimating an echo part in the signal picked up by the third microphone according to a convolution result of the filter weight and the reference signal; and subtracting the echo part from the signal picked up by the third microphone to obtain an echo-canceled signal, and determining the echo-canceled signal as the signal picked up by the third microphone.

9. The earphone signal processing method of claim 1, further comprising: performing voice activity detection by use of the third microphone to determine whether a person is speaking, and executing the dual-microphone noise reduction in combination with a voice activity detection result.

10. The earphone signal processing method of claim 9, wherein performing the voice activity detection by use of the third microphone to determine whether the person is speaking comprises:

estimating noise power of the signal picked up by the third microphone, calculating a signal to noise ratio (SNR) of the signal picked up by the third microphone, comparing the SNR with a predetermined SNR threshold, determining that the person is speaking when the SNR is greater than the threshold, and determining that the person is not speaking when the SNR is less than the threshold.

11. An earphone signal processing system, comprising:

a processor; and a memory for storing instructions executable by the processor;

wherein the processor is configured to:

acquire a signal picked up by a first microphone of an earphone at a position close to a mouth outside an ear canal;

acquire a signal picked up by a second microphone of the earphone at a position away from the mouth outside the ear canal;

acquire a signal picked up by a third microphone of the earphone, the third microphone being in a cavity formed by the earphone and the ear canal;

perform dual-microphone noise reduction on the signal picked up by the first microphone and the signal picked up by the second microphone to obtain a first intermediate signal;

perform dual-microphone noise reduction on the signal picked up by the second microphone and the signal picked up by the third microphone to obtain a second intermediate signal;

fuse the first intermediate signal and the second intermediate signal to obtain a fused voice signal; and output the fused voice signal.

12. The earphone signal processing system of claim 11, wherein the processor is configured to execute the dual-microphone noise reduction on the signal picked up by the first microphone and the signal picked up by the second microphone by use of beamforming processing.

13. The earphone signal processing system of claim 11, wherein the processor is configured to execute the dual-microphone noise reduction on the signal picked up by the second microphone and the signal picked up by the third microphone by use of a normalized least mean square (NLMS) adaptive filtering algorithm.

14. The earphone signal processing system of claim 11, wherein the fused voice signal comprises a low-frequency part of the second intermediate signal and a medium-high frequency part of the first intermediate signal.

15. The earphone signal processing system of claim 14, wherein the processor is configured to:

extract the medium-high frequency part of the first intermediate signal and the low-frequency part of the second intermediate signal based on a predetermined dividing frequency respectively, and combine two extracted signals directly; or extract low-frequency parts and medium-high frequency parts of the first intermediate signal and the second intermediate signal based on the predetermined dividing frequency respectively, perform weighted fusion on the first intermediate signal and the second intermediate signal in the low-frequency parts and on the first intermediate signal and the second intermediate signal in the medium-high frequency parts according to different weights, and combine weighted results of the two parts to obtain the fused voice signal; or correspondingly divide the first intermediate signal and the second intermediate signal to multiple sub bands, perform weighted fusion on the first intermediate signal and the second intermediate signal in each sub band according to different weights, and combine weighted results of each sub band to obtain the fused voice signal.

16. The earphone signal processing system of claim 15, wherein the weights for the weighted fusion are predetermined, wherein the weight of the second intermediate signal is greater during low-frequency fusion, and the weight of the first intermediate signal is greater during medium-high frequency fusion; or the weights for the fusion are adaptively adjusted according to acoustic environment, wherein the weight of the first intermediate signal during the low-frequency fusion is increased in response to a sound pressure level being low, and the weight of the second intermediate signal during the low-frequency fusion is increased in response to the sound pressure level being high.

17. The earphone signal processing system of claim 11, wherein the processor is configured to execute acoustic echo cancellation (AEC) processing on the signal picked up by the third microphone.

18. The earphone signal processing system of claim 17, wherein the processor is configured to:

take the signal picked up by the third microphone as a target signal and take a downlink signal as a reference signal, obtain an optimal filter weight by use of a normalized least mean square (NLMS) adaptive filtering algorithm;

estimate an echo part in the signal picked up by the third microphone according to a convolution result of the filter weight and the reference signal; and subtract the echo part from the signal picked up by the third microphone to obtain an echo-canceled signal, and determine the echo-canceled signal as the signal picked up by the third microphone.

19. The earphone signal processing system of claim 11, wherein the processor is further configured to perform voice activity detection by use of the third microphone to determine whether a person is speaking, and execute the dual-microphone noise reduction in combination with a voice activity detection result.

20. An earphone, comprising a first microphone, a second microphone and a third microphone, wherein the first microphone is at a position close to a mouth outside an ear canal, the second microphone is at a position away from the mouth outside the ear canal, and the third microphone is in a cavity formed by the earphone and the ear canal; and wherein the earphone signal processing system of claim 11 is arranged in the earphone.

* * * * *